US006691384B2

(12) United States Patent
Glasa

(10) Patent No.: US 6,691,384 B2
(45) Date of Patent: Feb. 17, 2004

(54) BUCKLE FOR SAFETY BELTS

(75) Inventor: Stefan Glasa, Hamburg (DE)

(73) Assignee: Bernhardt Apparatebau GmbH U. Co. (DE)

( * ) Notice: Subject to any disclaimer, the term of this patent is extended or adjusted under 35 U.S.C. 154(b) by 0 days.

(21) Appl. No.: 10/091,192

(22) Filed: Mar. 5, 2002

(65) Prior Publication Data

US 2002/0124362 A1 Sep. 12, 2002

(30) Foreign Application Priority Data

Mar. 7, 2001 (DE) ..... 201 03 958 U

(51) Int. Cl.[7] ..... A44B 11/14; A44B 11/25
(52) U.S. Cl. ..... 24/633; 24/642; 24/656
(58) Field of Search ..... 24/614, 625, 629, 24/633, 640, 641, 642, 636, 653, 656, 664

(56) References Cited

U.S. PATENT DOCUMENTS 4,069,559 A * 1/1978 Weman ..... 24/650
4,307,494 A * 12/1981 Gasse et al. ..... 24/634
4,313,246 A * 2/1982 Fohl ..... 24/635
4,321,734 A * 3/1982 Gandelman ..... 24/648
4,334,341 A * 6/1982 Krautz et al. ..... 24/635
4,355,442 A * 10/1982 Sato ..... 24/642
4,672,725 A * 6/1987 Kasai ..... 24/625
5,027,481 A * 7/1991 Frano ..... 24/606
5,170,539 A * 12/1992 Lundstedt et al. ..... 24/196
5,182,837 A * 2/1993 Anthony et al. ..... 24/642
5,419,020 A * 5/1995 Murai ..... 24/625
5,561,891 A * 10/1996 Hsieh ..... 24/581.1
5,604,964 A * 2/1997 Aoshima ..... 24/632
6,154,936 A * 12/2000 Howell et al. ..... 24/625

* cited by examiner

*Primary Examiner*—Anthony Knight
*Assistant Examiner*—André L. Jackson
(74) *Attorney, Agent, or Firm*—R W Becker & Associates; R W Becker

(57) ABSTRACT

A buckle for safety belts is provided, especially for the waist belt of a life preserver. The buckle has a tongue plate, the pins of which are insertable into a slot-shaped recess of a main body in which are displaceably disposed two securing elements, which cooperate with the pins for locking the buckle, and which are resiliently biased into the locking position.

6 Claims, 2 Drawing Sheets

BUCKLE FOR SAFETY BELTS

BACKGROUND OF THE INVENTION

The present invention relates a buckle for safety belts, especially for the waist belt of a life preserver.

Such buckles, which are comprised, for example, of an orifice plate and a tongue plate, with the pins of the tongue plate terminating in a mushroom-shaped head, should be easy to close and to open, which is effected by inserting the pin into or removing it from the orifice of the pertaining plate. The buckle plates themselves are secured to the ends of the belts that are to be fastened, and impart to the entire arrangement such a strength that, for example, the waist belt of a life preserver that is to be used at sea, can at the same time be utilized as a rescue belt for receiving or holding a person that has fallen overboard. In addition to these characteristics, the buckle to a large extent yields to the body movements of the person wearing the safety belt without the belt thereby opening. Unfortunately, the heretoforeknown buckles, with which the orifice in the orifice plate has the shape of a square or rectangle, do not provide the necessary locking reliability. In addition, in order to be able to open and close such a buckle, the orifice and pin plates must be rotated relative to one another in order to be able to introduce or remove the mushroom-shaped head of the pin into or out of the opening of the orifice plate. This manipulation is not only cumbersome, but is also very difficult in a cold and moist environment, such as on the deck of a ship.

It is therefore an object of the present invention to provide a safety belt buckle that is easy to open and to close and that, despite optimum freedom of movement of the belt in the region of the buckle, reliably prevents an unintentional opening of the buckle.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
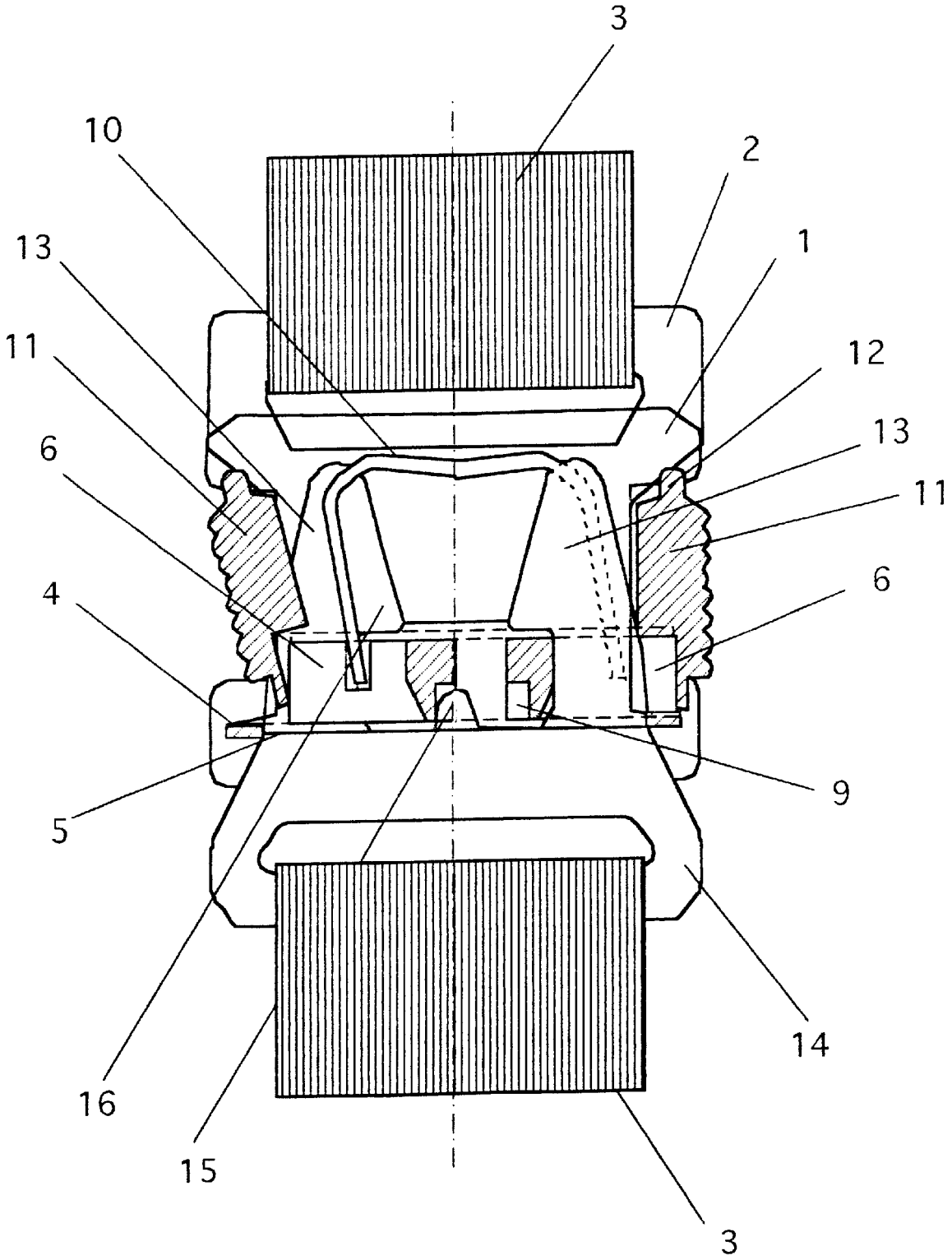
FIG. 1 is a partially cross-sectioned plan view of one exemplary embodiment of the inventive safety belt buckle, whereby the unlocked or disengaged position is shown in the left half of FIG. 1 and the locking or engaging buckle position is shown in the right half.
Figure 3:
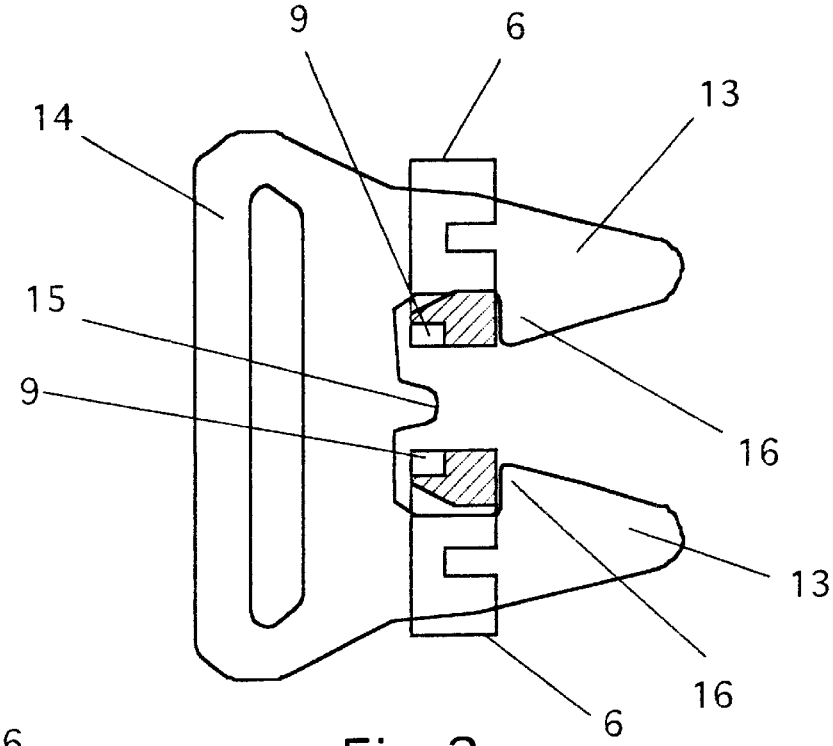
FIG. 3 is a partially cross-sectioned plan view of the tongue plate and the securing elements of the locked buckle of FIG. 1.

For realizing the aforementioned object, the safety belt buckle of the present invention is characterized primarily by a tongue plate, the pins of which can be inserted into a slot-shaped recess of a main body in which are displaceably disposed two securing elements that cooperate with the pins for locking the buckle, with the securing elements being resiliently biased into the locking position.

Manipulation of the inventive buckle is very straightforward, since in order to lock the buckle it is merely necessary to introduce the tongue plate into the slot-shaped recess of the main body. In so doing, the securing elements are displaced against the biasing that is exerted on them by the pins of the tongue plate as they pass by the securing elements. When the tongue plate is inserted entirely into the main body, the securing elements hook behind arresting shoulders on the pins and are held in this positive connection by the biasing force. To open the buckle, the safety elements must be moved toward one another against the force of the biasing from the outside of the buckle, for example with the thumb and index finger of one hand, in order to release the positive connection between the tongue plate and the securing elements and to be able to withdraw the tongue plate from the main body. Since in so doing always two elements must simultaneously be displaced, an unintentional opening of the buckle should never occur.

Pursuant to one expedient specific embodiment of the present invention, the tongue plate has an essentially U-shaped profile, and the pins, which are formed by the legs of the U-profile, are provided on their inner surfaces with arresting shoulders that are disposed across from one another and that engage under or behind the securing elements. In this connection, it has proven useful, in order during unlocking of the buckle to ensure a central position of the securing elements, to form on the cross member of the U-shaped profile of the tongue plate, in the middle between the legs or pins, a centering projection, and to also provide in each securing element a recess into which the centering projection engages when the securing elements are in the unlocked or open position.

To facilitate the insertion of the tongue plate into the main body, the pins can be tapered in the direction of their free end.

Further specific features of the present invention will be described in detail subsequently.

DESCRIPTION OF PREFERRED EMBODIMENTS

Referring now to the drawings in detail, the main body of the safety buckle is essentially formed from two parallel walls 1 that define an intermediate space and that are interconnected at one rim portion 2, in which the end of a belt strap 3 is secured. At that end that is opposite the rim portion 2, the intermediate space is delimited by an end plate 4 that is mounted on the walls 1 and that is provided with a slot opening 5.

Figure 2:
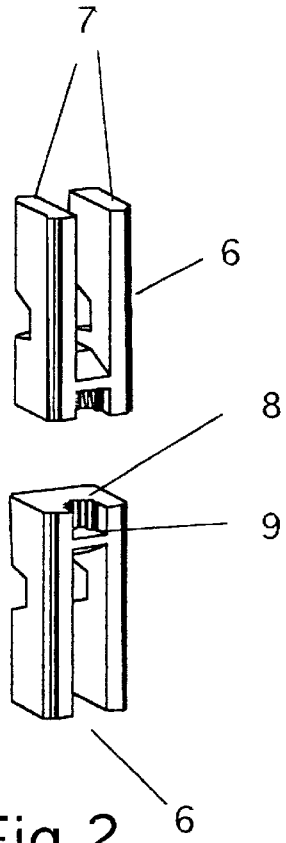
FIG. 2 is a perspective view of the securing elements of the buckle of FIG. 1.

Adjacent to the end plate 4, two securing elements 6 are disposed between the walls 1 so as to be displaceable parallel to the end plate 4. Each securing element 6 is formed from two rectangular pieces 7 (see FIG. 2) which at that narrow end that faces toward the center of the safety buckle are interconnected by a crosspiece 8. Formed in the crosspiece 8 is a recess 9 that faces toward the slot opening 5 in the end plate 4. By means of U-shaped spring elements 10, the securing elements 6 are biased into the engaged or locking position of the buckle.

The securing elements 6 can be manually displaced against the force of the spring elements 10 via push buttons 11 that engage against that narrow end of the securing elements 6 that is disposed opposite the crosspiece 8. By means of a foot 12, at that end that is remote from the securing element 6, each push button 11 is pivotably held in the main body.

The main body is additionally surrounded by a housing, which for reasons of clarity and simplification is not illustrated.

Figure 4:
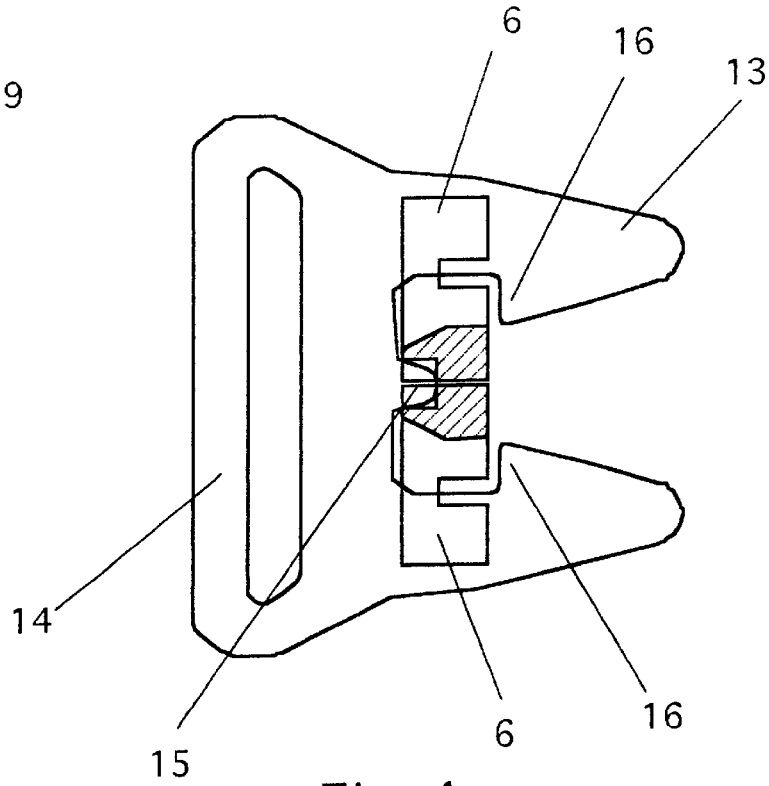
FIG. 4 is a partially cross-sectioned plan view of the tongue plate and the securing elements of the unlocked or disengaged buckle of FIG. 1.

The pins 13 of a pin or tongue plate 14 can be introduced into the intermediate space of the main body through the slot opening 5 and the end plate 4. When the pins 13 are inserted into the main body, they pass into a gap between the pieces 7 of the securing elements 6. In so doing, each inner surface of the pins 13 comes into engagement with the crosspiece 8 of the securing element 6 and displaces the latter against the force of the spring elements 10 into the position that is illustrated in FIG. 4 and in the left hand portion of FIG. 1. In addition, in this connection a centering projection 15, which is disposed on the tongue plate 14 between the pins 13, extends into the recesses 9 on the crosspiece 8 of the securing elements 6. The pins 13 have a wedge-shaped configuration, and are provided on the opposed or facing inner surfaces with a respective arresting shoulder 16 behind which, when the tongue plate 14 is inserted entirely into the base body, engages the crosspiece 8 of the securing element 6. The securing elements are not only held in this locking or engaged position by the spring elements 10, but are also moved into this position as soon as the arresting shoulders 16 have passed by the crosspieces 8.

To open the buckle and remove the tongue plate 14 from the main body, it is merely necessary to displace the securing elements 6 into the position shown in FIG. 4 and the left hand side of FIG. 1 by moving the push buttons 11 against the force of the spring elements 10, for example with the thumb and index finger of one hand. In this position, the arresting shoulders 16 no longer engage behind the crosspieces 8 of the securing element 6, so that the tongue plate 14 can be withdrawn from the main body. It should be noted that the other end of the belt 3 is held at that rim of the tongue plate 14 that is opposite the pins 13.

The specification incorporates by reference the disclosure of German priority document 201 03 958.3 filed Mar. 07, 2001.

The present invention is, of course, in no way restricted to the specific disclosure of the specification and drawings, but also encompasses any modifications within the scope of the appended claims.

I claim:

1. A buckle for safety belts, comprising:

a main body having a slot-shaped recess;

two securing elements displaceably disposed in said main body;

a tongue plate having an essentially U-shaped profile and pins formed by legs of said U-shaped profile that are insertable in an insertion direction into said slot-shaped recess of said main body, said pins having inner surfaces that face one another with each inner surface forming an arresting shoulder that is adapted to engage behind a respective one of said securing elements, wherein said pins cooperate with said securing elements for a locking of said buckle;

spring means for independently biasing each of said securing elements into a locking position in which the respective said securing element is extended laterally outwardly such that a respective one of said arresting shoulders is engaged behind the respective said securing element; and a pair of locking position release means, each of said locking position release means being movable independent of the other of said locking position release means to effect lateral inward movement, in a lateral direction perpendicular to said insertion direction, of a respective one of said securing elements against the bias of said springs means independent of any lateral movement or not of the other of said securing elements, the unlocking of said buckle from its looking position requiring contemporaneous engagement of both of said pair of locking position release means to thereby effect contemporaneous lateral inward movement of both of said securing elements, whereupon said arresting shoulders of said pins are no longer engaged behind said securing elements and said tongue plate can be withdrawn from said slot-shaped recess of said main body.

2. A buckle according to claim 1, wherein said pins of said tongue plate are tapered in a direction toward a free end thereof.

3. A buckle according to claim 1, wherein each of said locking position release means is secured to said main body such that the application of a force by a buckle user on a respective one of said locking position release means solely in a lateral direction is sufficient to move the respective said locking position release means in a manner which effects said lateral inward movement of the respective associated one of said securing elements against the bias of said spring means.

4. A buckle according to claim 3, wherein each of said locking position release means is secured to said main body at a pivot connection and the application of a force by the buckle user on a respective one of said locking position release means effects pivoting movement of the respective said locking position release means about its pivot connection.

5. A buckle for safety belts, comprising:

a main body having a slot-shaped recess;

two securing elements displaceably disposed in said main body;

a tongue plate having pins that are insertable into said slot-shaped recess of said main body, wherein said pins cooperate with said securing elements for a locking of said buckle; and spring means for biasing said securing elements into a locking position, wherein said tongue plate has an essentially U-shaped profile, wherein said pins are formed by legs of said U-shaped profile, and wherein inner surfaces of said pins that face one another are respectively provided with an arresting shoulder that is adapted to engage behind a respective one of said securing elements and wherein a crossmember of said U-shaped tongue plate, in a central portion between said pins, is provided with a centering projection, and wherein each of said securing elements is provided with a recess into which said centering projection engages when said securing elements are disposed in an unlocking or open position.

6. A buckle according to claim 5, wherein said pins of said tongue plate are tapered in a direction toward a free end thereof.

* * * * *